United States Patent [19]

Renner

[11] 4,090,186

[45] May 16, 1978

[54] SIGNALING DEVICE

[76] Inventor: Harold J. Renner, 8141 Utah St., Buena Park, Calif. 90621

[21] Appl. No.: 748,524

[22] Filed: Dec. 8, 1976

[51] Int. Cl.[2] ..... G08B 23/00

[52] U.S. Cl. ..... 340/321; 340/383

[58] Field of Search ..... 340/321, 277

[56] References Cited

U.S. PATENT DOCUMENTS

| | | | |
|---|---|---|---|
| 1,951,431 | 3/1934 | Meehan | 340/277 |
| 2,825,898 | 3/1958 | Stanley | 340/321 |
| 3,810,091 | 5/1974 | Hoover | 340/321 X |

*Primary Examiner*—Thomas B. Habecker
*Attorney, Agent, or Firm*—Roger A. Marrs

[57] ABSTRACT

A device for signaling traffic on highways is disclosed herein and includes an elongated handle fixedly supporting a sign board on one end thereof. The board is provided with a central opening for mounting or placement of a flash tube or bulb so that the light rays radiating from the bulb progress outwardly from both sides of the board. A pair of parabolic reflectors are arranged in back-to-back relationship to increase the illumination of light be radiated. The bulb is carried on a snap-clip which secures a pair of reflectors together and a Fresnel lens covers both reflectors to further enhance the light radiation. The board includes a display area for carrying indicia co-related to warning of the traffic. Batteries in electrical circuits connected to the bulb, a switch and an interruption circuit are carried in the elongated handle.

1 Claim, 3 Drawing Figures

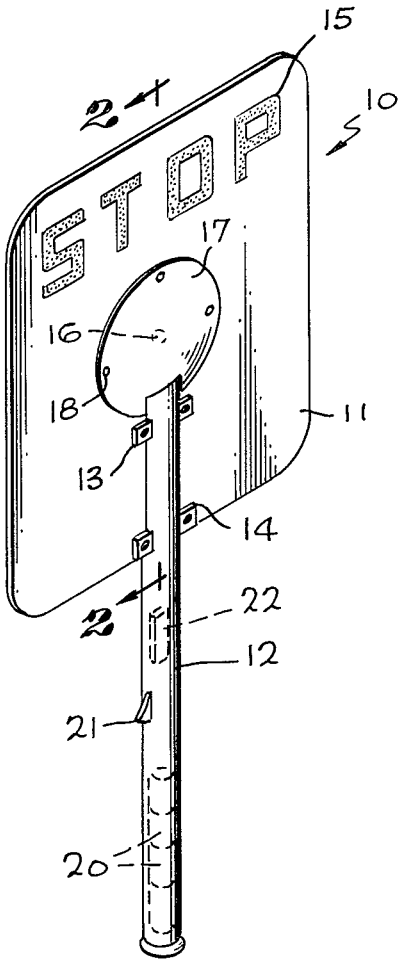
Fig. 1
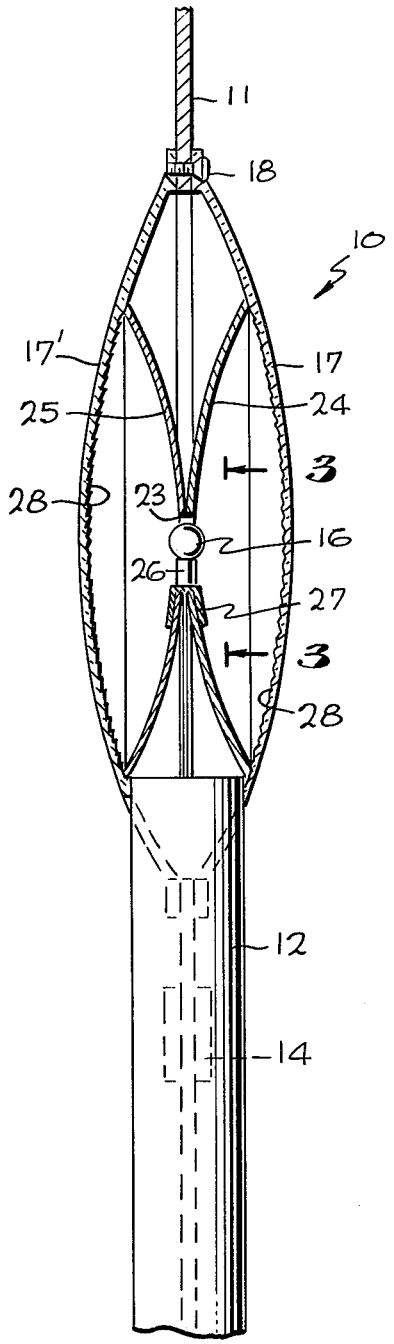
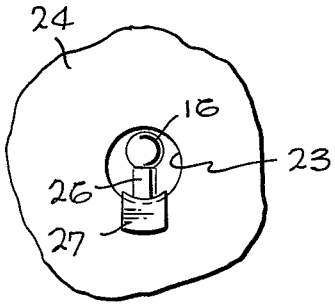
Fig. 3
Fig. 2

SIGNALING DEVICE

BACKGROUND OF THE INVENTION

1. Field of the Invention

This invention relates to means for signaling traffic on roadways and more particularly to a hand-held signaling device for indicating warning or traffic messages to the drivers of vehicular traffic at intersecting roads, crossroads, railroad crossings or the like.

2. Brief Description of the Prior Art

In the past, numerous devices have been provided for signaling oncoming traffic to danger or for providing general instructions. However, these prior art devices are primarily complicated signals which require some form of automatic control and the signals are generally mounted or fixed to the ground adjacent to the roadway. The devices are not portable and are not intended to be moved about or to be relocated for alternate uses.

Some attempts have been made to provide highway crossing signals which are disclosed in U.S. Letters Pat. Nos. 2,254,774; 1,728,687; and 2,124,480. Although these devices appear to be operable for their intended purposes, they are typical of the prior art which discloses complex and cumbersome devices which are not portable or adapted for manual use. In some instances, the prior art devices will lie only upon a single visual warning such as indicia placed on a cantilevered arm and in other cases, only a light is flashed for gaining the attention of a driver. Furthermore, the prior art devices are of a stationary nature once they have been installed and their automatic features placed into operation. Since they are stationary, no means are provided for permitting a physical movement of the device in combination with pictorial indicia and flashing lights to attract attention of oncoming drivers.

Therefore, there has been a long standing need to provide a simple hand-held signaling device which displays indicia as well as a flashing light to attract attention of vehicular traffic.

SUMMARY OF THE INVENTION

Accordingly, the above problems and difficulties are obviated by the present invention which provides a novel hand-held signaling device having an elongated handle carrying a display or sign board on one end thereof. Centrally located on the sign board is a flashing light tube or bulb which radiates light rays outwardly from opposite sides of the board. The light rays are enhanced by parabolic reflectors carried on the board and coaxially disposed with respect to the opening in the board and the light bulb or tube per se. The board includes a display area for carrying indicia and the handle of the device houses the batteries and electrical circuits for operating the flash tube or bulb.

Therefore, it is among the primary objects of the present invention to provide a novel hand-held signaling device which is simple in construction and easy to operate by unskilled persons.

Another object of the present invention is to provide a novel signaling device which is manually portable and which includes warning indicia as well as a flashing light warning to oncoming traffic.

Still another object of the present invention is to provide a novel flashing emergency sign wherein light is radiated from opposite sides of a common sign board carrying warning indicia.

A further object of the present invention is to provide a novel hand-held sign or signaling device incorporating flashing visual means and pictorial indicia that may be readily carried by a person conducting pedestrians across the street or for signaling traffic at crossroads or intersections.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a perspective view of the novel signaling device of the present invention showing the device in a typical hand-held application;

FIG. 2 is an enlarged longitudinal cross-sectional view of the signaling device shown in FIG. 1 as taken in the direction of arrows 2—2 thereof; and FIG. 3 is an elevational view of the flash tube or bulb taken in the direction of arrows 3—3 of FIG. 2.

DESCRIPTION OF THE PREFERRED EMBODIMENT

Referring to FIG. 1, the novel signaling device of the present invention is illustrated in the general direction of arrow 10 which includes a sign or indicia board 11 which is carried on one end of an elongated handle 12. The board 11 is secured to the handle by means of fasteners 13 and 14, which are semi-circular members which encircle the handle and fasten at their opposite ends to the board by means of bolts, screws rivots or the like. The board 11 includes a display area 15 on which a variety of indicia may be carried. For example, the word "STOP" may be placed on both sides of the board and this message is conveyed to the drivers of vehicular traffic when a crosswalk guard waves the signaling device.

The board 11 includes a central opening in which is carried a flashing tube or light 16 so that light may radiate outwardly from opposite sides of the board 11. Colored lenses 17 are coaxially disposed with respect to the bulb 16 on opposite sides of the board which enhance the radiation of light from the bulb. The lenses 17 are secured to the board via fasteners, such as fastener 18.

The handle 12 is cylindrical and houses a plurality of dry cell batteries such as battery 20 and incorporates a switch 21 for energizing the electrical circuit. An interrupter device 22 is carried in the handle 12 and is operably connected to the electrical circuit for interrupting the circuit momentarily so that the bulb or tube 16 will flash. The device may take the form of a capacitor discharge or any other circuit interruption device.

Referring now in detail to FIG. 2, it can be seen that the flash tube or bulb 16 substantially occupies a small opening or aperture 23 in the board 11. It can also be seen that a pair of reflectors 24 and 25 are arranged in a back-to-back relationship and include a coaxial and co-extensive hole or opening substantially occupied by the flashing tube or bulb 16. The pair of reflectors 24 and 25 as well as a socket 26 for the bulb 16 are held together by a clip 27. The clip is snap fastened over the edge of the co-extensive aperatures or openings and exerts a yieldable force there against for holding the reflectors to the board and for holding the socket 26 and bulb 16 in position. It can also be seen that the lenses 17 and 17 prime include an irregular back surface identified by numeral 28 which constitutes a Fresnel lens system. This irregular service enhances radiation of the light radiating from the device.

In FIG. 3, it can be seen that the bulb 16 and socket 26 substantially occupy the opening 23 formed in the board 11 and co-extensive with the opening and hole in the reflectors 24 and 25.

In view of the foregoing, it can be seen that the signaling device of the present invention provides a novel means for alerting or warning the drivers of vehicular traffic. The handle 12 is grasped by the hand of the user such as a crosswalk guard and the switch 21 is depressed to energize the electrical circuit including batteries 20 and interruptor switch 22. The bulb 16 flashes and the light radiating therefrom is enhanced by the lenses 17 and 17 prime. Light is also reflected from the smooth and parabolic surfaces of the reflectors 24 and 25.

In addition to the flashing light and the amber or red color of the lenses 17, attention of drivers is directed to the indicia located on the display area 15. By this means, the signaling device of the present invention may be employed for a variety of purposes.

While particular embodiments of the present invention have been (shown and) described, it will be obvious to those skilled in the art that changes and modifactions may be made without departing from this invention in its broader aspects and, therefore, the aim in the appended claims is to cover all such changes and modifications as fall within the true spirit and scope of this invention

What is claimed is:

1. A hand held signaling device comprising:

a sign board having broad flat display surfaces constituting the obverse and reverse sides thereof and having a centrally located opening surrounded by said obverse and said reverse sides;

a pair of parabolic coaxial reflectors arranged back-to-back with respect to each other so as to totally occupy said board central opening and having concentric openings provided in the apex thereof and coaxially disposed with respect to said board central opening;

a flash element mounted in said concentric parabolic reflector openings substantially occupying the open area thereof;

a clip removably retaining said flash element to both of said reflectors at the edge marginal region of said concentric openings;

a pair of concave lenses carried on opposite sides of board retaining said flash element and both of said reflectors onto said board wherein the edges of said reflectors bear against the backside of said lens respectively;

means removably securing said lens to each side of said board covering said reflectors and said flash element;

an elongated handle having one end thereof secured to said sign board;

electrical circuit means carried in said handle and operably coupled to said flash element for selectively energizing said element;

said clip includes a docket for releasably mounting said flash tube, and further includes a pair of spring legs biased together to yieldably grip with the edge marginal region of said reflectors;

each of said lens is a Fresnel lens.

* * * * *